United States Patent [19]

Scalera

[11] 4,260,905

[45] Apr. 7, 1981

[54] DEVICE FOR SETTING DIP SWITCHES

[75] Inventor: Frank T. Scalera, Maplewood, N.J.

[73] Assignee: Rowe International Inc., Whippany, N.J.

[21] Appl. No.: 90,504

[22] Filed: Nov. 1, 1979

[51] Int. Cl.[3] ..... H01H 3/02; H01H 27/00

[52] U.S. Cl. ..... 307/115; 200/17 R; 200/331

[58] Field of Search ..... 200/330, 331, 332, 5 B, 200/17 R, 329, 339; 307/115, 149

[56] References Cited

U.S. PATENT DOCUMENTS 3,264,443 8/1966 Farina et al. ..... 200/331

FOREIGN PATENT DOCUMENTS 1138844 1/1960 Fed. Rep. of Germany ..... 200/331

*Primary Examiner*—George H. Miller, Jr.
*Assistant Examiner*—James L. Dwyer
*Attorney, Agent, or Firm*—Shenier & O'Connor

[57] ABSTRACT

A device for setting the switches of a circuitboard-carried dual in-line package [DIP] which includes an array of miniature closely lined switch actuators such as toggle elements adapted to be rocked around a common axis to open and close their associated switches, which device has a recess with an outline configuration conforming to that of the package to receive the upper portion of the package to bring the lower ends of a plurality of operating arms pivotable around a common axis and having an interarm spacing corresponding to the toggle elements spacing into cooperative relationship with the toggle elements. The arms have offset handles with progressively increasing offsets from the center handles outwardly and extend through slots in the cover of the device so that the interhandle spacing is appreciably greater than is the spacing between adjacent switch toggle elements. Each handle is movable between two positions at which its arm holds the corresponding toggle element at positions at which its switch is open or is closed. Springs resiliently retain the handles in the positions to which they have been moved. Preferably the cover of the device is provided with legends adjacent the handles indicating prices to which they correspond and the device is provided with another legend indicating the correct orientation of the device with reference to the switch package.

10 Claims, 6 Drawing Figures

DEVICE FOR SETTING DIP SWITCHES

BACKGROUND OF THE INVENTION

The art of merchandising machines is becoming increasingly complex in that a greater variety of articles are being sold at prices covering a much wider range than has heretofore been done. For example, in some merchandising machines as many as forty different selections are afforded and the selections may be sold over a range of prices from $.05 to $3.15 in five cent increments. The price of a particular article in such a machine may be digitally set by closing selected ones of a number of switches which respectively correspond to five cents, ten cents, twenty cents, forty cents, eighty cents and a $1.60. However, in order to afford the desired number of selections each of which may sell at a different price, forty groups of six switches each or 240 switches must be provided. It will readily be appreciated that to accommodate such a great number of switches in common use would require an inordinate amount of space.

Especially adapted for the solution of the problem outlined above is the dual in-line package of switches [DIP] which is an assembly of, for example, six miniature switches with which there are associated six miniature closely spaced switch actuating elements such as toggle elements. These elements are selectively manually moved to one of two positions either to make or not make connections between respective associated pairs of output conductors of the package. In use of these DIP switches each package of, for example, six switches is mounted on a circuit board with the pairs of output conductors thereof extending through holes in the board and with the toggle elements accessable from the top of the board. With a number of these packages assembled on the board corresponding in number to the number of selections provided the elements of each assembly must be actuated to set the switch for the price at which the corresponding selection is to be sold. Owing to the miniature size of operating elements even where legends are provided and persons having acute vision are employed to set the prices, setting of the switches is extremely difficult. Often it is done by use of the point of a pen or pencil which may obliterate legends which have been applied to the package. This problem is compounded by the fact that price changes of the articles sold in the machine are not infrequent so that it often becomes necessary to change the switch settings. It will readily be appreciated that setting up of a machine having forty selections by use of the DIP switches described above is a tedious and time consuming operation.

SUMMARY OF THE INVENTION

One object of my invention is to provide a device for setting DIP switches.

Another object of my invention is to provide an assembly for setting DIP switches which greatly facilitates the operation of setting up a merchandising machine to dispense a large number of different articles selling at various prices.

A further object of my invention is to provide a device for setting DIP switches which is extremely simple in its construction and in its operation.

A still further object of my invention is to provide a device for setting DIP switches which is rugged in construction.

Yet another object of my invention is to provide a device for setting DIP switches which is reliable in operation.

A further object of my invention is to facilitate the setting of merchandising machine DIP switches, a number of which are to be set to sell at the same price.

A still further object of my invention is to provide a device for setting DIP switches which operates without the danger of damaging the components of the switches.

Other and further objects of my invention will appear from the following description.

In general my invention contemplates the provision of a device for setting the switches of a circuit-board-carried dual in-line package [DIP] which includes an array of miniature closely spaced lined switch actuators such as toggle elements adapted to be rocked around a common axis to open and close their associated switches, which device has a recess with an outline configuration conforming to that of the package to receive the upper portion of the package to bring the lower ends of a plurality of operating arms pivottable around a common axis and having an interarm spacing corresponding to the toggle elements spacing into cooperative relationship with the toggle elements. I provide the arms with offset handles having progressively increasing offsets from the center handles outwardly and extending through slots in the cover of the device so that the interhandle spacing is appreciably greater than is the spacing between adjacent switch toggle elements. Each handle is movable between two positions at which its arm holds the corresponding toggle element at positions at which its switch is open or is closed. Springs resiliently retain the handles in the positions to which they have been moved. Preferably the cover of the device is provided with legends adjacent the handles indicating prices to which they correspond and the device is provided with another legend indicating the correct orientation of the device with reference to the switch package.

BRIEF DESCRIPTION OF THE DRAWINGS

In the accompanying drawings which reference is made in the instant specification and which forms a part thereof and in which like reference characters are used to indicate like parts in the various views.

DESCRIPTION OF THE PREFERRED EMBODIMENT

Figure 1:
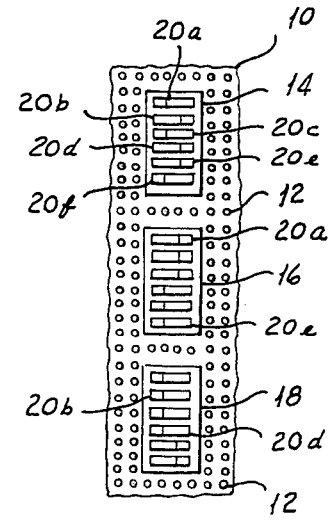
FIG. 1 is a fragmentary plan of a circuit board carrying a number of DIP switch assemblies.
Figure 2:
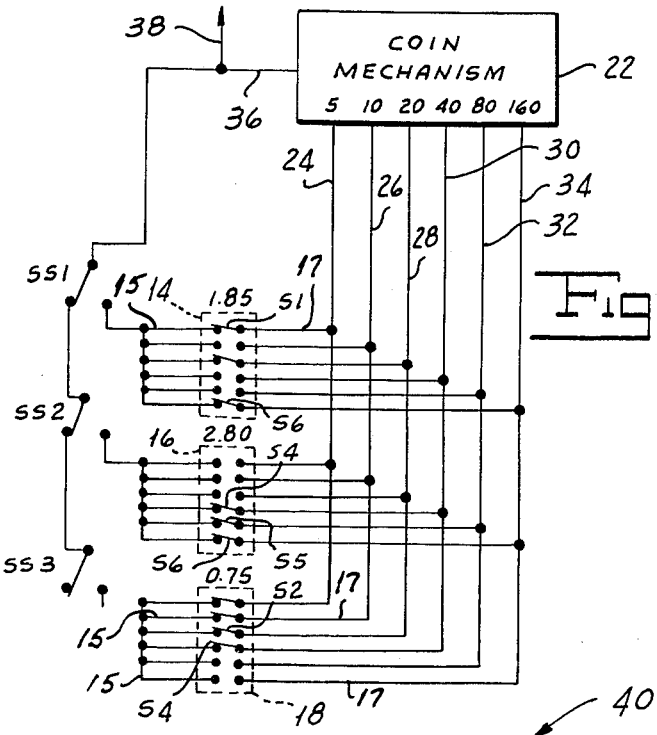
FIG. 2 is a schematic view illustrating one way in which the DIP switch assembly of FIG. 1 may be employed in a merchandising machine control circuit.
Figure 6:
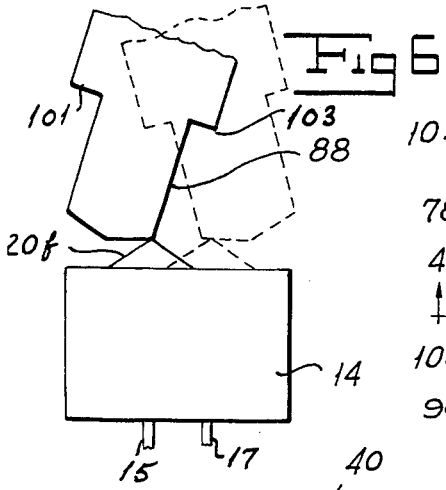
FIG. 6 is a fragmentary view drawn on an enlarged scale illustrating the manner in which my device for setting DIP switches changes the position of the switch actuating element of a DIP switch.
Figure 3:
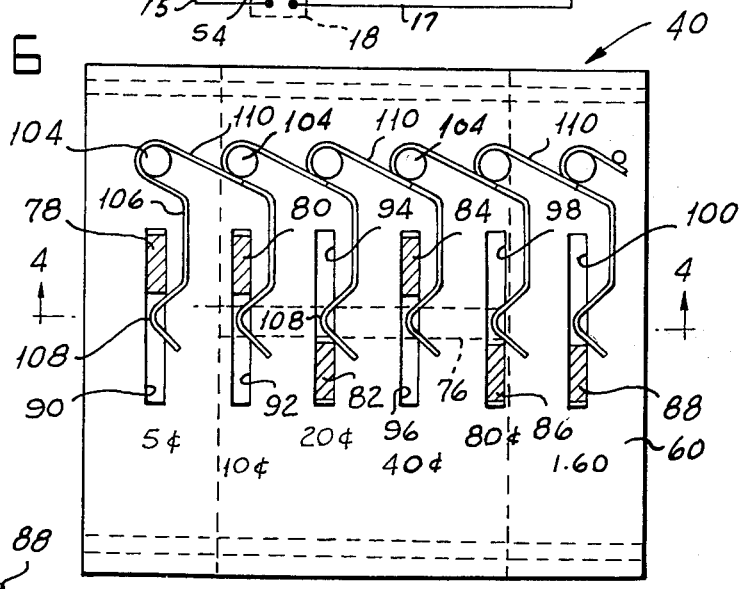
FIG. 3 is a top plan of my device for setting DIP switches with parts shown in section.
Figure 4:
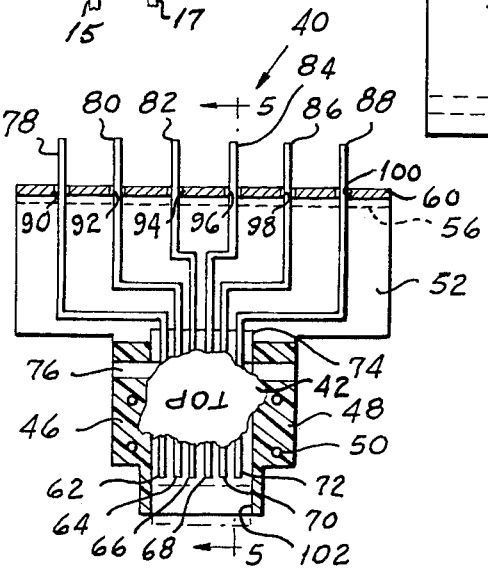
FIG. 4 is a section of the assembly shown in FIG. 3 taken along the line 4—4 of FIG. 3 and drawn on a reduced scale.
Figure 5:
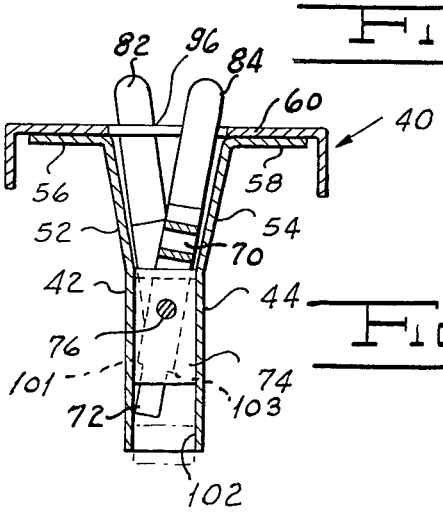
FIG. 5 is a section of my device for setting DIP switches taken along the line 5—5 of FIG. 4.

Referring now to FIGS. 1 and 2 of the drawings a fragment 10 of a circuit board is provided with a plurality of holes 12. As many DIP switch assemblies as there are selections of a merchandising machine with which the board 10 is used are assembled on the board. While as many as forty such assemblies may be applied to the board in FIG. 1 I have illustrated only three DIP switch assemblies 14, 16 and 18 which are assembled on the board with the plurality of pairs of conductors 15 and 17 of each switch of the assembly extending through a pair of holes 12. Each of the DIP switch assemblies such as assembly 14 includes six switch actuating elements 20*a* through 20*f* which may, for example, be toggle elements. Corresponding to the toggle elements each switch assembly includes six switches S1 to S6. As is known in the art, in one position of a toggle element 20 the corresponding switch is closed while in the other position of the toggle element the switch is open. Since the DIP switch assemblies per se form no part of my invention they will not be described in detail.

In use in the control circuit of a merchandising machine, for example, the assemblies 14, 16 and 18 may be associated with a coin mechanism 22 having respective price lines 24, 26, 28, 30, 32 and 34 corresponding to acceptance by the coin mechanism of sums of five cents, ten cents, twenty cents, forty cents, eighty cents and 1.60. I connect the respective price lines to one terminal of each of the respective switches S1 to S6 of each of the assemblies 14, 16 and 18. I connect the other switch contacts of the switches of each assembly to a respective common line leading to one terminal of a respective selecting switch SS1, SS2 or SS3.

Coin mechanism 22 which may be of any suitable type known to the art such, for example, as that shown in U.S. Pat. No. 4,034,839, puts out a series of interrogating pulses on a line 36 connected to the poles of switches SS1 through SS3. A line 38 leads from line 36 to a vend relay winding [not shown] which is adapted to be energized when a selection switch SS1, SS2 or SS3 is operated and when the corresponding DIP switch assembly 14, 16 or 18 has been set for a price at least the equivalent of which has been accepted by the mechanism 22. In normal operation of the system the interrogating impulses put out by line 36 are not sufficiently strong to energize the vend relay. When, however, a sum in coins aggregating the purchase price of a selected article has been accepted by the mechanism 22 and the corresponding selecting switch is operated, line 36 puts out a potential which is of sufficient magnitude to operate the vend relay.

As has been pointed out hereinabove, the coin mechanism 22 is adapted to accept a sum in money up to $3.15. The switch assemblies 14, 16 and 18 may be so set as to close certain of the switches S1 to S6 corresponding to a particular price. By way of example, I have shown elements 20*a*, 20*c* and 20*f* of assembly 14 in positions at which the corresponding switches S1, S3 and S6 are closed so that the selection associated with selection switch SS1 is set to sell for $1.85. Similarly switch 16 is set so that its selection sells at $2.80 and unit 18 has been set so that its selection sells at $.75.

Referring now to FIGS. 3 to 6, my device indicated generally by the reference character 40 for operating a DIP switch assembly includes respective side plates 42 and 44 separated by spacer blocks and assembled therewith by any suitable means such, for example, as screws 50. Diverging portions 52 and 54 of the side plates 42 and 44 extend upwardly to flanges 56 and 58 welded or otherwise secured to a top plate 60 of the device 40.

The device 40 includes a plurality of actuator operating arms 62, 64, 66, 68, 70 and 72 separated from each other and located with reference to the blocks 46 and 48 by spacers 74 so that the arms have an interarm spacing which corresponds to the inter-element spacing of the elements 20 of a switch assembly such as the assembly 14. A shaft 76 carried by the blocks 46 and 48 permits pivotal movement of the arms 62, 64, 66, 68, 70 and 72 on the shaft.

I provide the arms 62, 64, 66, 68, 70 and 72 with respective offset handles 78, 80, 82, 84, 86 and 88. As can readily be seen in the drawings the offsets of the handles increase outwardly from that provided for the center handles 82 and 84 to that provided for the handles 78 and 88. Thus the interhandle spacing of the handles 78, 80, 82, 84, 86 and 88 is appreciably greater than is the inter-element spacing of the elements 20. Handles 78, 80, 82, 84, 86 and 88 extend upwardly through respective slots 90, 92, 94, 96, 98 and 100 and the cover plate 60.

I so arranged the elements of the device that each handle and its associated arm is movable between respective limit positions at which shoulders 101 and 103 located above a reduced end portion of the arm engage the plates 42 and 44. The portion of the device 40 at the lower end of the body 46 and 48 and at the lower ends of plates 42 and 44 forms a generally rectangular space having an outline configuration conforming to the outline configuration of the body 14 for example, so that the space 102 is able to receive the body. Moreover, the depth of the space 102 is such that with the lower end of the device in engagement with the surface of board 10 the lower ends of the arms are in cooperative relationship with the switch elements 20.

I provide the cover plate 60 with a plurality of spaced posts 104 carrying springs 106, one end 108 of which is adapted to engage associated handle and the other end of which engages an adjacent post. Thus each spring 106 serves to hold its associated handle in that position to which it has last been moved.

Preferably I provide the top of the cover plate 60 with legends adjacent to the handles indicating the prices to which the handles correspond. In addition I provide the legend "top" on plate 42, for example, the orientation with which the assembly should be placed on the switch.

In use of my device 40 to set the switches of an assembly such as the assembly 14 and with reference to the legend "top" I first place the device over the package 14 so that the body of the package is received in the opening 102 and so that the respective arms 78, 80, 82, 84, 86 and 88 corresponding respectively to five cents, ten cents, twenty cents, forty cents, eighty cents and $1.60 are over the switch elements 20*a* to 20*f* corresponding to these sums of money. When that has been done the handles are so moved as to set the corresponding switches to aggregate the price at which the corresponding article is to be sold.

It will be seen that I have accomplished the objects of my invention. I have provided a device for setting the switches of a dual in line package in a simple and expeditious manner. My device greatly facilitates setting of the prices in the control circuit of a merchandising machine which is adapted to sell a variety of articles over a wide range of prices. My device is extremely simple in construction and operation for the result achieved thereby. It is rugged in construction. It is reliable in operation.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a merchandising machine control circuit having a plurality of price lines and a plurality of selection switches and a plurality of assemblies each having a body of a certain outline configuration carrying a plurality of switches and a plurality of aligned closely spaced switch actuators each of which is movable between two positions corresponding to the respective states of the switches associated therewith to connect certain of said price lines to one of said selecting switches to set the price of the article corresponding to said one switch, a device for individually setting the switches of said assemblies including in combination, a housing forming an opening having an outline configuration conforming to that of said body to permit said housing to receive said body through said opening, a plurality of operating arms, means mounting said operating arms in said housing with an interarm spacing corresponding to the spacing between said actuators and for pivotal movement around an axis generally parallel to the direction of alignment of said actuators between respective positions at which they move actuators positioned adjacent thereto between said two positions, a plurality of offset handles connected to said operating arms, said handles having progressively greater offsets with reference to the direction of alignment of said actuators whereby said handles have an interhandle spacing which is appreciably greater than the spacing between adjacent actuators, a top cover for said housing, a plurality of slots in said cover through which said handles extend, means for limiting movement of each arm and its connected handle to positions corresponding to the two positions of the associated actuators, resilient means for releasably holding each of said arm and its connected handle in the position to which it has been moved, a plurality of first legends on said housing cover for indicating the prices of said price lines to which said handles correspond, and a second legend on said housing indicating the proper orientation of said housing with reference to said body.

2. In a merchandising machine control circuit having a plurality of price lines and a plurality of selection switches and a plurality of assemblies each having a body of a certain outline configuration carrying a plurality of switches and a plurality of aligned closely spaced switch actuators each of which is movable between two positions corresponding to the respective states of the switches associated therewith to connect certain of said price lines to one of said selecting switches to set the price of the article corresponding to said one switch, a device for individually setting the switches of said assemblies including in combination, a housing forming an opening having an outline configuration conforming to that of said body to permit said housing to receive said body through said opening, a plurality of operating arms, means mounting said operating arms in said housing with an interarm spacing corresponding to the spacing between said actuators and for pivotal movement around an axis generally parallel to the direction of alignment of said actuators between respective positions at which they move actuators positioned adjacent thereto between said two positions, a plurality of offset handles connected to said operating arms, said handles having progressively greater offsets with reference to the direction of alignment of said actuators whereby said handles have an interhandle spacing which is appreciably greater than the spacing between adjacent actuators, a top cover for said housing, a plurality of slots in said cover through which said handles extend, means for limiting movement of each arm and its connected handle to positions corresponding to the two positions of the associated actuators, resilient means for releasably holding each of said arm and its connected handle in the position to which it has been moved, and a plurality of legends on said housing cover for indicating the prices of said price lines to which said handle correspond.

3. In a merchandising machine control circuit having a plurality of price lines and a plurality of selection switches and a plurality of assemblies each having a body of a certain outline configuration carrying a plurality of switches and a plurality of closely spaced switch actuators each of which is movable between two positions corresponding to the respective states of the switches associated therewith to connect certain of said price lines to one of said selecting switches to set the price of the article corresponding to said one switch, a device for individually setting the switches of said assemblies including in combination, a housing forming an opening having an outline configuration conforming to that of said body to permit said housing to receive said body through said opening, a plurality of operating arms, means mounting said operating arms in said housing with an interarm spacing corresponding to the spacing between said actuators and for pivotal movement around an axis generally parallel to the direction of alignment of said actuators between respective positions at which they move actuators positioned adjacent thereto between said two positions, a plurality of offset handles connected to said operating arms, said handles having progressively greater offsets with reference to the direction of alignment of said actuators whereby said handles have an interhandle spacing which is appreciably greater than the spacing between adjacent actuators, a top cover for said housing, a plurality of slots in said cover through which said handles extend, means for limiting movement of each arm and its connected handle to positions corresponding to the two positions of the associated actuators and resilient means for releasably holding each of said arm and its connected handle in the position to which it has been moved.

4. In a merchandising machine control circuit having a plurality of price lines and a plurality of selection switches and a plurality of assemblies each having a body of a certain outline configuration carrying a plurality of switches and a plurality of aligned closely spaced switch actuators each of which is movable between two positions corresponding to the respective states of the switches associated therewith to connect certain of said price lines to one of said selection switches to set the price of the article corresponding to said one switch, a device for individually setting the switches of said assemblies including in combination, a housing forming an opening having an outline configuration conforming to that of said body to permit said housing to receive said body through said opening, a plurality of operating arms, means mounting said operating arms in said housing with an interarm spacing corresponding to the spacing between said actuators and for pivotal movement around an axis generally parallel to the direction of alignment of said actuators between respective positions at which they move actuators positioned adjacent thereto between said two positions, a plurality of offset handles connected to said operating arms, said handles having progressively greater offsets with reference to the direction of alignment of said actuators whereby said handles have an interhandle spacing which is appreciably greater than the spacing between adjacent actuators.

5. In a merchandising machine control circuit having a plurality of price lines and a plurality of selection switches and a plurality of assemblies each having a plurality of switches and a plurality of closely spaced switch actuators each of which is movable between two positions corresponding to the respective states of the switches associated therewith to connect certain of said price lines to one of said selecting switches to set the price of the article corresponding to said one switch, a device for individually setting the switches of said assemblies including in combination, a plurality of switch actuator operating elements, means mounting said operating elements with an interelement spacing corresponding to the interactuator spacing of each of said switch assemblies and for individual movement between first and second positions at which they move the associated actuators between their respective positions when brought into operative relationship therewith, and means including means for mechanically magnifying the space between said elements for individually operating said elements to set said switches.

6. A device for manually individually setting the switches of an assembly having a body of a certain outline configuration carrying a plurality of aligned closely spaced switch actuators each of which is movable between two positions corresponding to the respective states of the switch associated therewith including in combination, a housing forming an opening having an outline configuration conforming to that of said body to permit said housing to receive said body through said opening, a plurality of operating arms, means mounting said operating arms in said housing with an interarm spacing corresponding to the spacing between said actuators and for pivotal movement around an axis generally parallel to the direction of alignment of said actuators between respective positions at which they move actuators positioned adjacent thereto between said two positions, a plurality of offset handles connected to said operating arms, said handles having progressively greater offsets with reference to the direction of alignment of said actuators whereby said handles have an interhandle spacing which is appreciably greater than the spacing between adjacent actuators, a top cover for said housing, a plurality of slots in said cover through which said handles extend, means for limiting movement of each arm and its connected handle to positions corresponding to the two positions of the associated actuators and resilient means for releasably holding each of said arm and its connected handle in the position to which it has been moved.

7. A device for manually individually setting the switches of an assembly having a body of a certain outline configuration carrying a plurality of aligned closely spaced switch actuators each of which is movable between two positions corresponding to the respective states of the switch associated therewith including in combination, a housing forming an opening having an outline configuration conforming to that of said body to permit said housing to receive said body through said opening, a plurality of operating arms, means mounting said operating arms in said housing with an interarm spacing corresponding to the spacing between said actuators and for pivotal movement around an axis generally parallel to the direction of alignment of said actuators between respective positions at which they move actuators positioned adjacent thereto between said two positions, a plurality of offset handles connected to said operating arms, said handles having progressively greater offsets with reference to the direction of alignment of said actuators whereby said handles have an interhandle spacing which is appreciably greater than the spacing between adjacent actuators, a top cover for said housing and a plurality of slots in said cover through which said handles extend.

8. A device for manually individually setting the switches of an assembly having a body of a certain outline configuration carrying a plurality of aligned closely spaced switch actuators each of which is movable between two positions corresponding to the respective states of the switch associated therewith including in combination, a housing forming an opening having an outline configuration conforming to that of said body to permit said housing to receive said body through said opening, a plurality of operating arms, means mounting said operating arms in said housing with an interarm spacing corresponding to the spacing between said actuators and for pivotal movement around an axis generally parallel to the direction of alignment of said actuators between respective positions at which they move actuators positioned adjacent thereto between said two positions, and a plurality of offset handles connected to said operating arms, said handles having progressively greater offsets with reference to the direction of alignment of said actuators whereby said handles have an interhandle spacing which is appreciably greater than the spacing between adjacent actuators.

9. A device for manually individually setting the switches of an assembly having a plurality of aligned closely spaced switch actuators each of which is movable between two positions corresponding to the respective states of the switch associated therewith including in combination, a plurality of operating arms, means mounting said operating arms with an interarm spacing corresponding to the spacing between said actuators and for pivotal movement around an axis generally parallel to the direction of alignment of said actuators between respective positions at which they move actuators positioned adjacent thereto between said two positions, a plurality of offset handles connected to said operating arms, said handles having progressively greater offsets with reference to the direction of alignment of said actuators whereby said handles have an interhandle spacing which is appreciably greater than the spacing between adjacent actuators and means for orienting said operating arms with reference to said actuators.

10. A device for manually individually setting the switches of an assembly having a plurality of closely spaced switch actuators each of which is movable between two positions corresponding to the respective states of the switch associated therewith including in combination, a plurality of switch actuators operating elements, means mounting said operating elements with an interelement spacing corresponding to the interactuator spacing of said switch assembly and for individual movement first and second positions at which they move the associated actuators between their respective positions when brought into operative relationship therewith, and means including means for mechanically magnifying the space between said elements for individually operating said elements to set said switches.

* * * * *

UNITED STATES PATENT AND TRADEMARK OFFICE

CERTIFICATE OF CORRECTION

PATENT NO. : 4,260,905

DATED : April 7, 1981

INVENTOR(S) : Frank T. Scalera

It is certified that error appears in the above-identified patent and that said Letters Patent are hereby corrected as shown below:

Column 6, line 66, "selection" should read -- selecting --;

Column 10, line 2, before "first" insert -- between --.

Signed and Sealed this

*Twenty-third* Day of *June 1981*

[SEAL]

*Attest:*

RENE D. TEGTMEYER

*Attesting Officer*

*Acting Commissioner of Patents and Trademarks*